US005725418A

United States Patent [19]

Giebmanns

[11] Patent Number: 5,725,418

[45] Date of Patent: Mar. 10, 1998

[54] GRINDING UNIT

[76] Inventor: Thomas Giebmanns, 10 Cedardale Ct., Palm Coast, Fla. 32137

[21] Appl. No.: 596,243

[22] PCT Filed: Aug. 18, 1994

[86] PCT No.: PCT/EP94/02740

§ 371 Date: Mar. 8, 1996

§ 102(e) Date: Mar. 8, 1996

[87] PCT Pub. No.: WO95/07166

PCT Pub. Date: Mar. 16, 1995

[30] Foreign Application Priority Data

Sep. 10, 1993 [DE] Germany ..... 43 30 670.5

[51] Int. Cl.[6] ..... B24B 55/04

[52] U.S. Cl. ..... 451/65; 451/454; 451/452

[58] Field of Search ..... 451/65, 451, 452, 451/453, 454, 455, 223, 195, 220, 48

[56] References Cited

U.S. PATENT DOCUMENTS

| | | | |
|---|---|---|---|
| 2,572,212 | 10/1951 | Stebelton et al. . | |
| 3,830,019 | 8/1974 | Mann | 451/452 |
| 4,069,624 | 1/1978 | Henry, Jr. . | |
| 4,091,571 | 5/1978 | Nilsson | 451/455 |
| 4,991,358 | 2/1991 | Giebmanns | 451/455 |

FOREIGN PATENT DOCUMENTS

| | | | |
|---|---|---|---|
| 1399058 | 6/1964 | France . | |
| 1478321 | 10/1964 | France . | |
| 1552862 | 8/1967 | France . | |
| 325945 | 9/1920 | Germany . | |
| 2613160 | 10/1977 | Germany | 451/451 |
| 3734676 | 4/1989 | Germany . | |
| 254030 | 3/1946 | Switzerland . | |

*Primary Examiner*—Robert A. Rose
*Attorney, Agent, or Firm*—Robert W. Becker & Associates

[57] ABSTRACT

A grinding unit for producing standardized tools such as end milling or slot cutters, reamers, twist drills, screw taps, and the like. The grinding unit has a grinding spindle holder that is adapted to be mounted on a base. At least one grinding spindle that has a grinding wheel is secured to the grinding spindle holder. A carriage is movable on guides on the grinding spindle holder. A workpiece holder is movable on guides on the carriage transverse to the direction of movement of the carriage. A protective housing is secured to the carriage and extends closely around the workpiece holder and the grinding wheel.

10 Claims, 3 Drawing Sheets

GRINDING UNIT

BACKGROUND OF THE INVENTION

The invention relates to a grinding unit for manufacturing standardized tools such as slot cutters, reamers, twist drills, screw-taps, or the like.

Since such tools consist of high-quality tool steels, it is particularly important to prevent an overheating of the workpiece during grinding by furnishing great amounts of coolants. Since the aforementioned tools are normally provided with axial or helical grooves, the known grinding machines are designed as universal tool grinding machines which provide adjusting possibilities for the grinding spindle and the grinding wheel in order to grind the necessary grooves into the workpiece at various angles, as well to grind the workpiece circularly or to relief-grind the cutting edges.

In order to perform the necessary workpiece movements with regard to the grinding wheel, the grinding machines are provided with drives which may be strictly mechanical by providing guide elements exerting the required rotating movement for the grinding of helically grooved tools.

With CNC-controlled grinding machines, the movements of the workpiece and the grinding wheel are not necessarily effected mechanically but by electrically controlled servomotors.

The known grinding machines for grinding tools are in detail provided with a machine holder on which the elements necessary for the grinding process are arranged. The entire machine is surrounded by a hood in order to contain the coolant and to protect the operating personnel. In addition to the actual grinding machine, also peripheral devices are required such as hydraulic units, a coolant unit and an electrical unit. This means, that the known grinding machines require a substantial amount of space which is neither smaller with CNC-controlled grinding machines since the structure of the grinding machine is in principle the same and the peripheral devices are also necessary.

It is the object of the invention to provide a grinding unit that is particularly oriented to the manufacture of standard tools such as slot cutters, reamers, twist drills, screw-taps, or the like, requires little space, and can be easily exchanged as a unit for being adjusted to various tools to be manufactured, or, is provided with exchangeable elements for an adjustment to various tools.

SUMMARY OF THE INVENTION

Based on this object, a grinding unit is proposed that comprises according to the invention a grinding spindle holder that can be mounted on a support, at least one grinding spindle that is mounted on the grinding spindle holder and has a grinding wheel, a carriage that is movable on guides on the grinding spindle holder, a workpiece holder that is movable transversely to the carriage movement on guide means on the carriage, and a protective housing that is mounted on the carriage and that surrounds the workpiece holder and the grinding wheel tightly.

The inventive grinding unit can be mounted on any base, particularly on an already existing coolant unit so that no machine holding device is required and the required space is reduced. The inventive grinding unit can be built compactly and requires a small-dimensioned internal space within the protective housing because of the protective housing surrounding tightly the workpiece holder and the grinding wheel, so that it is possible to introduce into the protective housing a protective gas which displaces the oxygen so that an overheating of the surface of the workpiece because of the oxygen in the air is prevented.

The grinding spindle mounted on the grinding spindle holder is not adjustable but set for grinding a particular workpiece.

By the arrangement of a carriage that is movable on the grinding spindle holder on guides, the feed-motion of the workpiece relative to the grinding wheel is achieved while the advance, if necessary in connection with a rotation of the workpiece for grinding helical grooves, is made possible by the workpiece holder which is displaceable on guide means on the carriage, transversely to the carriage movement.

A grinding spindle with a horizontal axis parallel to the guides on the carriage can be arranged on the grinding spindle holder for grinding only mantle chamfers or a grinding spindle with an axis that is slanted toward the guides on the carriage for grinding helical grooves can be arranged thereon.

Also, it is possible, to arrange a grinding spindle on the grinding spindle holder with a horizontal axis and, at a distance therefrom, a grinding spindle with a slanted axis so that helical grooves and mantle chamfers can be ground with the same grinding unit.

In this case, the workpiece holder can be positioned in the area between the two grinding spindles, parallel to the grinding spindle with the horizontal axis, and can be provided with a sleeve shaft that is mounted within the workpiece holder and has a collet chuck holder for supporting longer workpieces and, in addition, a center point support means that is displaceable on the guide means and is coupled with the workpiece holder via a spring-loaded, adjustable connecting rod and that has a center point which is pressed against the workpiece by the spring-loaded connecting rod.

The center point can be removed from the workpiece by means of an extension of the connecting rod that co-operates with a stop on the carriage, by displacing the workpiece holder against the stop such that the connecting rod displaces the center point support means against the compression action of a spring relative to the workpiece holder.

A collet chuck can be mounted within the collet chuck holder and is tensioned by means of a spring-loaded drawbar that is connected with the collet chuck. Loosening of the collet chuck can, in this case, be effected by a pressure rod that can be force-impinged from the outside, is coaxial and actuates the drawbar in the loosening direction of the collet chuck.

In order to effect the necessary rotation of the workpiece for grinding helical grooves accompanied by a simultaneous, axial displacement, the shaft can be provided with an extension that has spline profiles and is guided through a worm wheel that is supported within a casing that is connected with the carriage, while a drive for the worm wheel can be provided. The protective housing can extend axially in the longitudinal direction of the workpiece holder and it can surround it tightly such that essentially a sufficient space corresponding with the advance movement is present in the axial direction, while in the area of the grinding wheels extensions corresponding with them and surrounding them tightly, can be provided.

For inserting and removing a workpiece and for exchanging the grinding wheels, the protective housing can be provided with at least one cover that provides access to the workpiece holder and the grinding wheels. Advantageously, the grinding spindles can be rotatable within holding tubes so that the holding tubes can be mounted within pillow blocks on the carriage holder.

BRIEF DESCRIPTION OF THE DRAWINGS

The invention is described in detail in the following with the help of an embodiment illustrated in the drawing. The drawing shows in.

DESCRIPTION OF PREFERRED EMBODIMENTS

Figure 1:
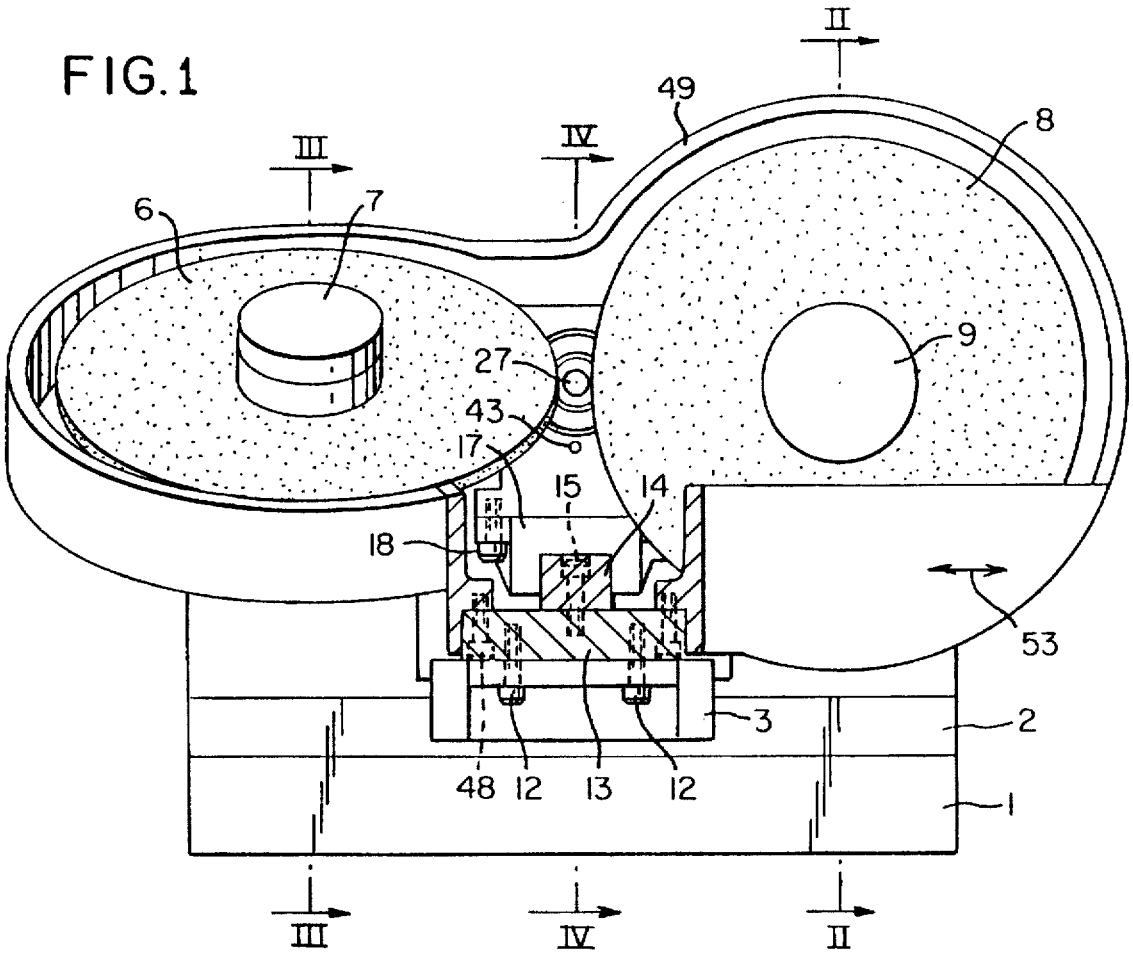
FIG. 1 a front view of the inventive grinding unit with the cover taken off the protective housing, partially in cross-section, FIG. 2 a cross-section of the grinding unit along line II—II of FIG. 1, FIG. 3 a cross-section along line III—III of FIG. 1, and FIG. 4 a cross-section along line IV–IV of FIG. 1.
Figure 2:
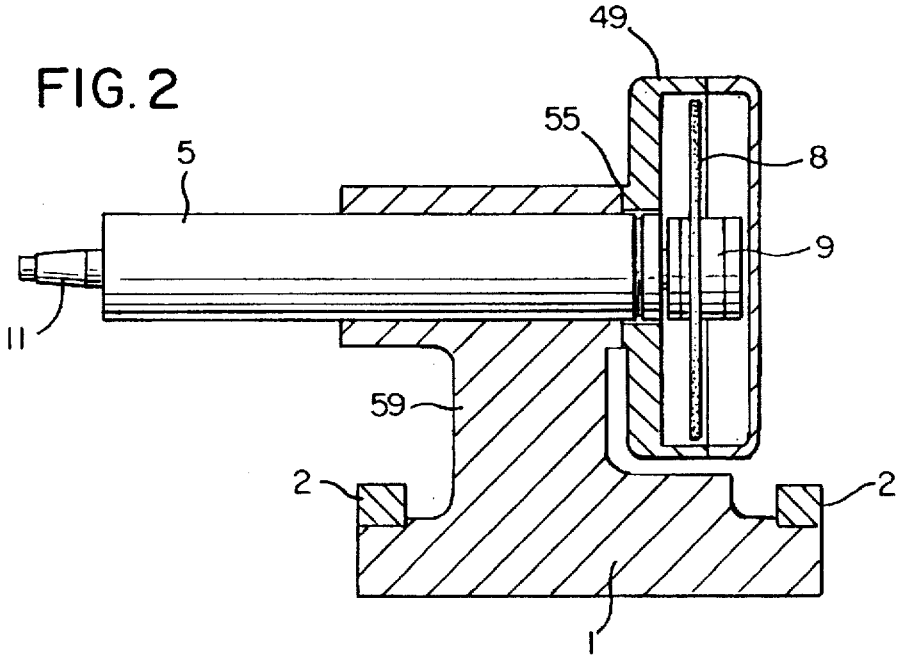
Figure 3:
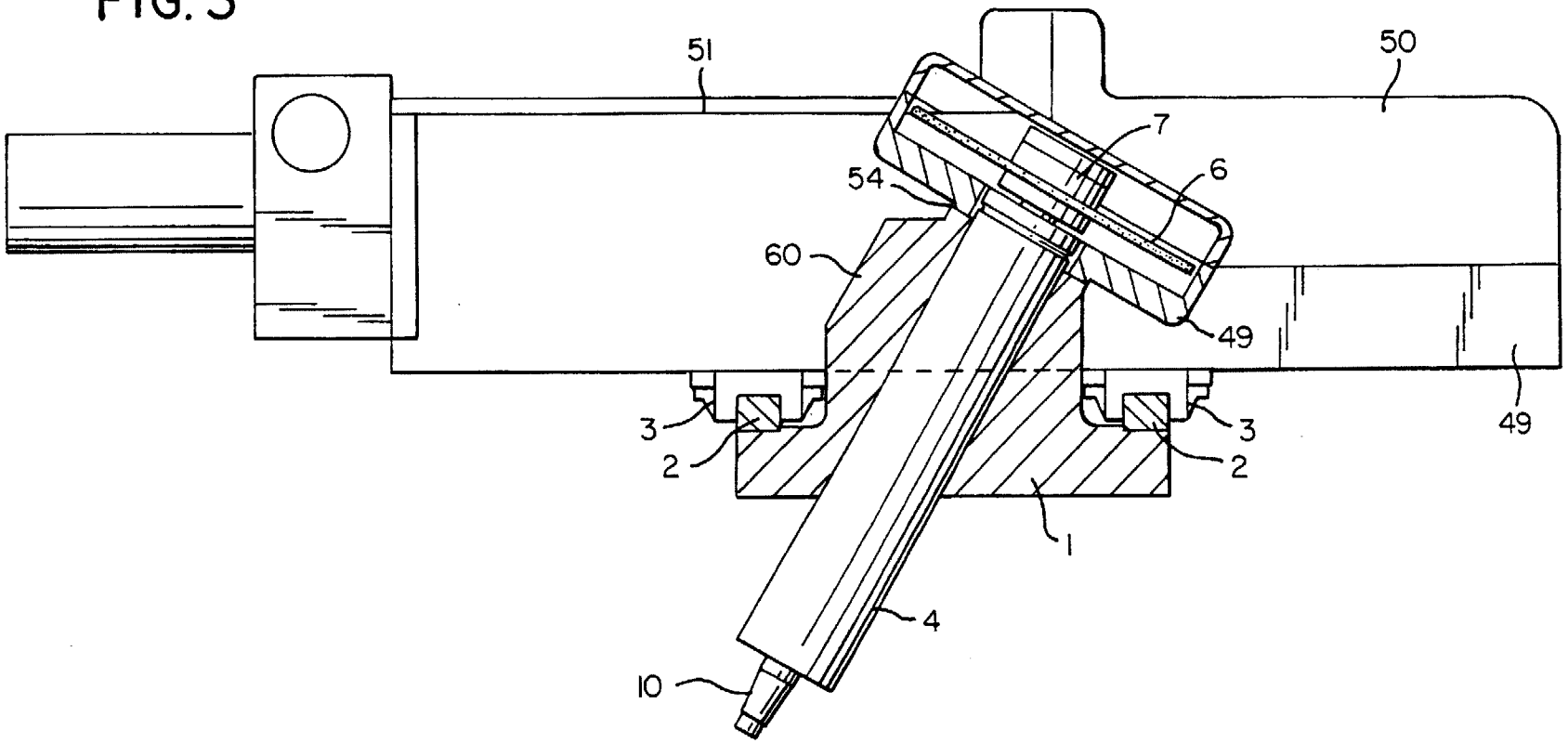

The grinding unit is provided with a base plate as a grinding spindle holder 1 on which in the present example, two grinding spindles 10, 11 with grinding wheels 6, 8 are positioned. For this purpose, the grinding spindle holder 1 is provided with a pillow block 59 within the bore of which a holding tube 5 is mounted. Within this holding tube 5, a grinding spindle 11 is supported by means of a ball bearing and carries at one end a grinding wheel 8 that is attached to the grinding spindle by means of a disc flange 9. The axis of the holding tube 5 with the grinding spindle 11 runs horizontally above guides 2 on the grinding spindle holder 1 and transversely to it. At the opposite end of the grinding spindle holder 1, a further pillow block 60 is positioned within the bore of which a holding tube 4 for a grinding spindle 10 with a grinding wheel 6 attached to the grinding spindle 10 by means of a disc flange 7 is positioned at an angle. The angle of the grinding spindle 10 within the holding tube 4 corresponds with the spiral angle of the grooves to be ground into a workpiece 27.

A carriage 13 is slidably supported on the carriage holder 1 via recirculating ball shoes 3. On this carriage 13, a protective housing 49 is attached which is provided with extensions in the area of the grinding wheels 6, 8, and with a cover consisting of two portions, one portion 50 of which provides access to one half of the interior space above the carriage 13 including the extensions for the grinding wheels 6, 8 and the other portion 51 of which is designed as a removable plate above the remaining area of the protective housing 49.

The recirculating ball shoes 3 are attached to the carriage 13 by screws 12, while the protective housing 49 is attached to the carriage by screws 48.

On the upper side of the carriage 13, a guide bar 14 is screwed on by screws 15. This guide bar 14 serves as a support for a workpiece holder 19 which can be slid essentially friction-freely on the guide bar 14 transversely to the moving direction of the carriage 13 by means of recirculating ball shoes 16, 17 which are free from play.

A sleeve shaft 20 is arranged on ball bearings 21 within the workpiece holder 19. These ball bearings 21 are axially fixed in position on the workpiece holder 19 by a cap 22, whereas these ball bearings 21 are spaced apart on the sleeve shaft 20 by a spacing tube 23 and are secured in place on the shaft 20 by a threaded nut 24.

A collet chuck holder 25 is mounted on the free end of the shaft 20 with screws 26. A collet chuck 28 which clamps the cylindrical workpiece 27 is inserted into this collet chuck holder 25.

A drawbar 29 which is guided through the sleeve shaft 20 is screw-connected with the collet chuck 28. The drawbar 29 is supported on the sleeve shaft 20 via a compression spring 30 and a threaded nut 31 such that the collet chuck 28 is pulled into the collet chuck holder 25 by the drawbar 29 under the effect of the compression spring 30 and clamps the workpiece 27.

The threaded nut 24 is connected with a splined shaft 32 that is guided through a worm wheel 34 to be axially displaceable, however, not to be pivotable relative to the worm wheel 34. The worm wheel 34 is provided with a bushing 35 on which a ball bearing is mounted. The bushing 35 is connected with the worm wheel 34 by screws 37. The ball bearing 36 is positioned within a casing 56 that is screw-connected to the protective housing 49 and in which is supported a worm 38 that engages the worm wheel 34.

For supporting the free end 39 of a longer workpiece 27, a center point support means 41 with a center point 40 is also supported on the guide bar 14 by means of a recirculating ball shoe in 42. The workpiece holder 19 and the center point support means 41 are coupled via a connecting rod 43. The connecting rod 43 is guided through a bore within the workpiece holder 19 and is supported on the workpiece holder 19 via a compression spring 46 and a pressure plate 45. This connecting rod 43 is guided in a similar way through a bore within the center point support means 41 and can be tightly connected with the center point support means 41 by a set screw 44.

Figure 4:
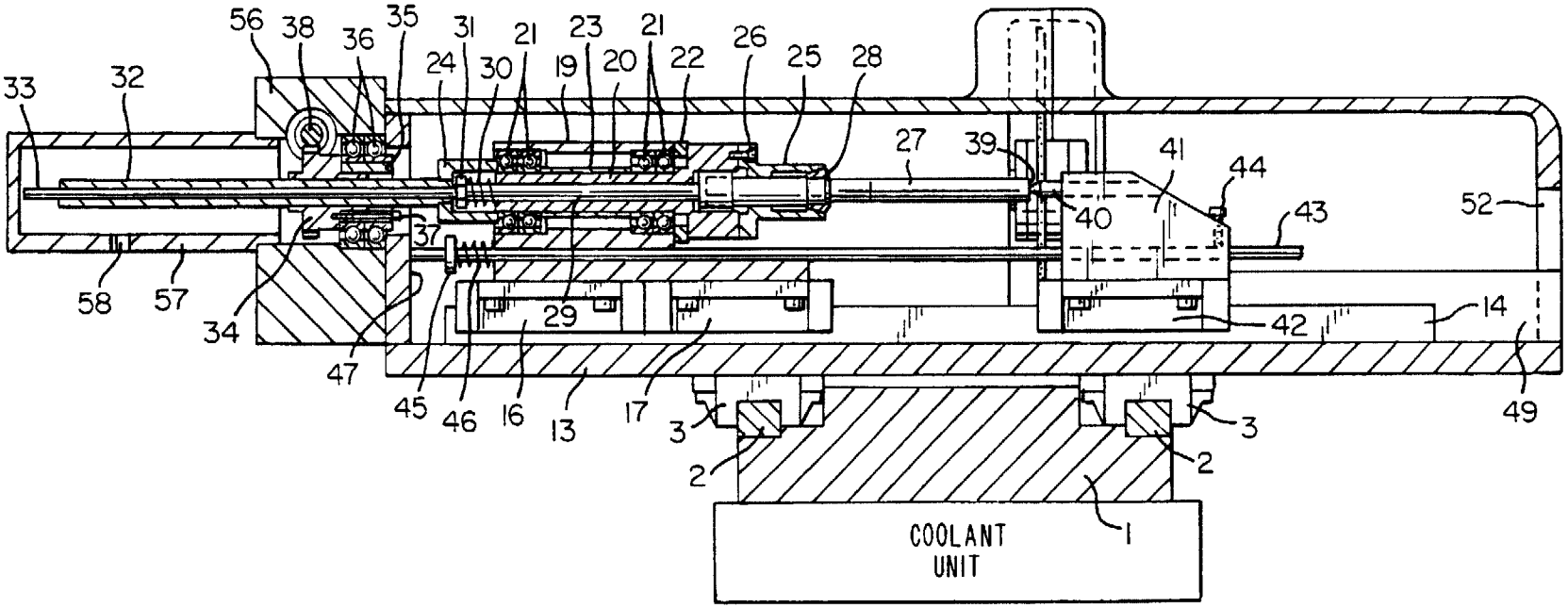

In order to machine a workpiece 27, the workpiece holder is moved into the position illustrated in FIG. 4 by a drive not shown in detail such that a pressure rod 33 comes into contact with a stop within a sealing tube 57 that is mounted to the casing 56. By this means, the drawbar 29 is displaced to the right and moves the collet chuck 28 out of the collet chuck holder 23 such that the collet chuck can spread open. At the same time, an extension of the connecting rod 43 comes into contact with a side wall 47 of the protective housing 49, the side wall 47 forming a stop for the connecting rod 43. Thus, the connecting rod 43 is also displaced toward the right when the compression spring 46 is compressed so that the distance between the workpiece holder 19 and the center point support means 41 increases. Now, the workpiece can be inserted into the collet chuck 28. If the workpiece holder 19 is thereupon displaced to the right, the collet chuck 28 is pulled into the collet chuckholder 25 due to the force of the compression spring 30 and clamps the workpiece 27. Simultaneously, or shortly after this, the center point support means 41 is drawn against the workpiece 27 by the acion of the compression spring 46 on the connecting rod 43, and the center point 40 engages a centering bore within the workpiece 27. The force with which the center point 40 gets pressed against the workpiece 27 can be adjusted with the help of the set screw 44 by positioning the center point 40 to contact the workpiece 27 when the workpiece 27 is clamped and the set screw is loosened and by moving the workpiece holder 19 toward the left such that the extension of the connecting rod 43 abuts the side wall 47 and compresses the compression spring 46. If the set screw 44 is now tightened and the workpiece holder 19 is again displaced toward the right, the compression spring 46 pulls the connecting rod 43 through the bore within the workpiece holder 19 and, thus, by a force that can be preset, the center point 40 against the workpiece 27.

It is to be understood that the extension of the connecting rod 43 has to come into contact with the side wall 47 of the protective housing 49 earlier than the pressure rod 33 against the end of the sealing tube 57 so that the distance between the workpiece holder 19 and the center point support means 41 increases and the center point 40 releases the free end 39 of the workpiece 27 before the collet chuck 28 releases the workpiece 27.

For grinding helical grooves, the carriage 13 is displaced in the direction of the grinding wheel 6 while the workpiece 27 that is clamped between the workpiece holder 19 and the center point support means 41 is axially displaced back and forth on the guide bar 14 and is simultaneously subjected to a rotating movement via the worm 38 and the worm wheel 34. This rotating movement is coupled with the axial movement such that a helical groove can be ground into the workpiece 27 at the preset angle. The workpiece 27 in the illustrated example is a standard slot or end milling cutter with a 30° helical groove. Accordingly, the holding tube 4 with the grinding spindle 10 and the grinding wheel 6 is positioned within the pillow block 60 in conformity with the twist angle.

For grinding a mantle chamfer at the cutting edges of the slot cutter, the carriage 13 is moved against the grinding wheel and is axially moved in the same manner with a simultaneous rotation.

The drive for the grinding wheels 6, 8, the movement of the carriage 13, of the workpiece holder 19, and the rotation of the workpiece may consist of drive motors which are driven by a CNC drive which is not illustrated.

For machining screw-taps, the same grinding unit can be utilized if the screw-tap may be provided with spiral grooves having a twist angle of 30°. In this case, the grinding wheel 8 is replaced by a single-rib or multi-rib grinding wheel.

For screw-taps with axial grooves or for corresponding reamers, the carriage holder 1 is replaced by one on which the grinding wheel 6 is positioned at a vertical axis. The carriage 13 with all the individual elements connected therewith remains unaltered.

Great amounts of coolant, particularly cooling oil, are introduced into the area of the engagement of the grinding wheels 6, 8 with the workpiece 27 in a not illustrated manner and can drain from the protective housing 49 through an opening 52. In order to prevent an oxidation of the workpiece 27 because of the heat that is generated during the grinding process and because of the cooling oil, a protective gas, e.g. nitrogen, that displaces the air and, thus, the oxygen of the air, can be introduced into the interior of the grinding unit.

The inventive grinding unit is designed to be compact and can be arranged on any base, preferably on a coolant unit. If necessary, several such grinding units may be arranged on the same coolant unit.

The present invention is, of course, in no way restricted to the specific disclosure of the specification and drawings, but also encompasses any modifications within the scope of the appended claims.

I claim:

1. A grinding unit for producing standardized tools, including end milling or slot cutters, reamers, twist reels, screw taps, comprising:

a grinding spindle holder that is adapted to be mounted on a base;

two non-adjustable yet exchangeable grinding spindles that are spaced from one another on said grinding spindle holder and are each provided with a respective grinding wheel;

a carraige that is movable on first guide means on said grinding spindle holder transverse to axes of said grinding spindles;

a workpiece holder that is movable on second guide means on said carriage transverse to a direction of movement of said carriage, said workpiece holder being provided for a workpiece that is to be clamped in between said spaced-apart grinding wheels; and a protective housing that is secured to said carriage and extends axially over and closely around said workpiece holder, said protective housing being provided with an extension that is adapted to said grinding wheels and extends closely around same, said protective housing also having at least one cover means to provide access to said workpiece holder and said grinding wheels.

2. A grinding unit according to claim 1, wherein one of said grinding spindles, for grinding surface chamfers, is provided with a horizontal axis that extends parallel to said second guide means on said carriage.

3. A grinding unit according to claim 2, wherein the other of said grinding spindles, for grinding helical grooves, is provided with an axis that extends at an angle to said second guide means on said carraige.

4. A grinding unit according to claim 1, which includes a sleeve shaft that is mounted in said workpiece holder and is provided with a collet chuck holder; and which further includes a center point support means that is movable on said second guide means and is coupled with said workpiece holder by means of a spring-loaded, adjustable connecting rod.

5. A grinding unit according to claim 4, wherein said connecting rod is provided with an extension that cooperates with a stop means on said carriage.

6. A grinding unit according to claim 4, which further includes: a collet chuck disposed in said collet chuck holder, a spring-loaded drawbar that is connected to the collet chuck, and a pressure rod that can be biased from the outside, is coaxial with said drawbar, and actuates said drawbar in a loosening direction of said collet chuck.

7. A grinding unit according to claim 4, which includes an extension of said shaft, said extension having a splined profile and being guided through a worm wheel that is mounted in a housing that is connected to the carriage; and which includes a drive means for said worm wheel.

8. A grinding unit according to claim 1, herein said grinding spindles are rotatably supported in holding tubes that are secured in pillow blocks on said grinding spindle holder.

9. A grinding unit according to claim 1, which includes at least one grinding spindle holder disposed on a single coolant unit.

10. A grinding unit according to claim 1, wherein said protective housing has an interior that is filled with a protective gas.

* * * * *